US009299524B2

(12) United States Patent
Divan

(10) Patent No.: US 9,299,524 B2
(45) Date of Patent: Mar. 29, 2016

(54) LINE CORD WITH A RIDE-THROUGH FUNCTIONALITY FOR MOMENTARY DISTURBANCES

(75) Inventor: Deepakraj Malhar Divan, San Jose, CA (US)

(73) Assignee: INNOVOLT, INC., Atlanta, GA (US)

( * ) Notice: Subject to any disclaimer, the term of this patent is extended or adjusted under 35 U.S.C. 154(b) by 1126 days.

(21) Appl. No.: 13/341,705

(22) Filed: Dec. 30, 2011

(65) Prior Publication Data

US 2012/0169141 A1 Jul. 5, 2012

Related U.S. Application Data

(60) Provisional application No. 61/428,585, filed on Dec. 30, 2010.

(51) Int. Cl.
*H01H 35/00* (2006.01)
*H01H 83/10* (2006.01)

(52) U.S. Cl.
CPC ..... *H01H 83/10* (2013.01); *Y10T 307/826* (2015.04)

(58) Field of Classification Search
CPC ..... H02H 11/00; H02J 9/06; H02J 9/061; H03K 17/0822; H05B 39/08; H01H 83/10; Y10T 307/826
USPC ..... 307/125
See application file for complete search history.

(56) References Cited

U.S. PATENT DOCUMENTS 3,109,930 A 11/1963 Macdonald
3,558,952 A 1/1971 Forbes
3,935,511 A 1/1976 Boulanger et al.
3,935,527 A 1/1976 Michelet et al.
3,982,137 A 9/1976 Penrod (Continued)

FOREIGN PATENT DOCUMENTS

EP 0 708 515 A1 4/1996
EP 0 986 158 A1 3/2000

(Continued)

OTHER PUBLICATIONS

Int'l Search Rpt & WO, Mar. 13, 2006, Int'l Searching Authority.

(Continued)

*Primary Examiner* — Thienvu Tran
*Assistant Examiner* — Brian K Baxter
(74) *Attorney, Agent, or Firm* — Morris, Manning & Martin, LLP; John R. Harris

(57) ABSTRACT

Novel circuits for providing ride-through during unpredictable power line disturbances are disclosed in connection with low-power electronic devices. Such low-power electronics devices are typically subjected to undesirable lock-ups and reboots under momentary power line disturbances such as voltage sags, voltage swells, and other momentary line power disturbances. Diagnostics and visual indication are also integrated in the circuits to allow consumers to correlate equipment lock-up and malfunction with power disturbances, and to provide service providers with various analytics and historical data on the recorded disturbances. To reduce cost, the disclosed circuits utilize a simple DC capacitor without any additional power conditioning switches or converters. In one exemplary embodiment, the disclosed circuits are embedded inside a power line cord to provide a ride-through during the brief interval of time such power line disturbances occur.

12 Claims, 10 Drawing Sheets

BLOCK DIAGRAM SCHEMATIC OF A CIRCUIT PROVIDING RIDE-THROUGH FUNCTIONALITY

(56) References Cited

U.S. PATENT DOCUMENTS

| | | | |
|---|---|---|---|
| 4,031,463 | A | 6/1977 | Norberg |
| 4,183,071 | A | 1/1980 | Russell |
| 4,250,531 | A | 2/1981 | Ahrens |
| 4,328,459 | A | 5/1982 | McLeod, Jr. |
| 4,396,882 | A | 8/1983 | Kellenbenz |
| 4,479,118 | A | 10/1984 | Cole, Jr. |
| 4,555,741 | A | 11/1985 | Masaki |
| 4,560,887 | A | 12/1985 | Schneider |
| 4,675,772 | A | 6/1987 | Epstein |
| 4,691,274 | A | 9/1987 | Matouk et al. |
| 4,782,241 | A | 11/1988 | Baker et al. |
| 4,858,054 | A | 8/1989 | Franklin |
| 4,924,342 | A | 5/1990 | Lee |
| 4,939,437 | A | 7/1990 | Farag et al. |
| 5,030,844 | A | 7/1991 | Li et al. |
| 5,032,738 | A | 7/1991 | Vithayathil |
| 5,063,303 | A | 11/1991 | Sackman et al. |
| 5,117,176 | A | 5/1992 | Bobry |
| 5,257,157 | A | 10/1993 | Epstein |
| 5,379,177 | A | 1/1995 | Bird |
| 5,386,183 | A | 1/1995 | Cronvich et al. |
| 5,418,678 | A | 5/1995 | McDonald |
| 5,448,442 | A | 9/1995 | Farag et al. |
| 5,519,264 | A | 5/1996 | Heyden et al. |
| 5,519,295 | A | 5/1996 | Jatnieks |
| 5,537,021 | A | 7/1996 | Weinberg et al. |
| 5,563,459 | A | 10/1996 | Kurosawa et al. |
| 5,619,127 | A | 4/1997 | Warizaya |
| 5,627,738 | A | 5/1997 | Lubomirsky et al. |
| 5,642,007 | A | 6/1997 | Gyugyi et al. |
| 5,689,395 | A | 11/1997 | Duffy et al. |
| 5,737,161 | A | 4/1998 | Thomas |
| 5,745,322 | A | 4/1998 | Duffy et al. |
| 5,864,458 | A | 1/1999 | Duffy et al. |
| 5,886,429 | A | 3/1999 | Grady et al. |
| 5,894,396 | A | 4/1999 | Kim |
| 5,907,192 | A | 5/1999 | Lyons et al. |
| 6,005,362 | A | 12/1999 | Enjeti et al. |
| 6,021,035 | A | 2/2000 | Larsen et al. |
| 6,046,921 | A | 4/2000 | Tracewell et al. |
| 6,112,136 | A | 8/2000 | Paul et al. |
| 6,118,676 | A | 9/2000 | Divan et al. |
| 6,163,469 | A | 12/2000 | Yuki |
| 6,178,080 | B1 | 1/2001 | Wilken et al. |
| 6,184,593 | B1 | 2/2001 | Jungreis |
| 6,456,097 | B1 | 9/2002 | Sutherland |
| 6,538,864 | B2 | 3/2003 | Mullner |
| 6,597,144 | B2 | 7/2003 | Pearson et al. |
| 6,621,668 | B1 | 9/2003 | Sare |
| 6,630,751 | B2 | 10/2003 | Curtis et al. |
| 6,744,612 | B2 | 6/2004 | Chen |
| 6,744,613 | B2 | 6/2004 | McCook et al. |
| 6,862,201 | B2 | 3/2005 | Hodge, Jr. |
| 7,012,793 | B2 | 3/2006 | Cheevanantachai et al. |
| 7,049,710 | B2 | 5/2006 | Dahlman |
| 7,099,135 | B2 | 8/2006 | Ball et al. |
| 7,184,279 | B2 | 2/2007 | Lee |
| 7,355,294 | B2 | 4/2008 | Teichmann |
| 7,504,821 | B2 | 3/2009 | Shuey |
| 7,525,777 | B2 | 4/2009 | Aromin |
| 7,541,696 | B2 | 6/2009 | Dawley |
| 7,630,185 | B2 | 12/2009 | Fiesoli et al. |
| 7,957,117 | B2 | 6/2011 | Divan et al. |
| 7,977,928 | B2 | 7/2011 | Fahrenbruch |
| 8,035,938 | B2 | 10/2011 | Divan |
| 2001/0021091 | A1 | 9/2001 | Weichler |
| 2002/0012261 | A1 | 1/2002 | Moindron |
| 2002/0122318 | A1 | 9/2002 | Guerrera |
| 2002/0149891 | A1 | 10/2002 | Neiger et al. |
| 2003/0052658 | A1 | 3/2003 | Baretich et al. |
| 2003/0107859 | A1 | 6/2003 | Pan et al. |
| 2003/0222747 | A1 | 12/2003 | Perkinson et al. |
| 2004/0017110 | A1 | 1/2004 | Yim |
| 2004/0070278 | A1 | 4/2004 | Divan et al. |
| 2004/0201931 | A1 | 10/2004 | Korcharz et al. |
| 2005/0088792 | A1 | 4/2005 | Mechanic et al. |
| 2008/0197819 | A1 | 8/2008 | Thompson et al. |
| 2010/0091421 | A1 | 4/2010 | Lee |
| 2010/0195258 | A1 | 8/2010 | Yang |

FOREIGN PATENT DOCUMENTS

| | | |
|---|---|---|
| EP | 0 862 261 B1 | 1/2004 |
| FR | 2 197 258 | 3/1974 |
| GB | 1076078 | 7/1967 |
| GB | 2284100 | 5/1995 |
| JP | 61-77634 | 5/1986 |
| JP | 05-049167 | 2/1993 |
| JP | 05-252650 A | 9/1993 |
| JP | 2001-025256 | 1/2001 |
| JP | 2001-136657 | 5/2001 |
| JP | 2003-259648 | 9/2003 |
| JP | 2004-304876 | 10/2004 |
| WO | WO 00/59087 A1 | 10/2000 |

OTHER PUBLICATIONS

Duran-Gomez, Jose Luis, et al., An Approach to Achieve Ride-Through of an Adjustable-Speed Drive with Flyback Converter Modules Powered by Super Capacitors, IEEE Transactions on Industry Applications, Mar./Apr. 2002, pp. 514-522, vol. 38, No. 2, IEEE, USA.

Electrotek, Voltage Sag Studies, http://www.electrotek.com/voltsag.htm, Feb. 16, 2006, pp. 1-5, Electrotek Concepts, USA.

Fischer, F. V., Applied Power Electronics in the Field of Voltage Dip-Proofing, http://www.measurlogic.com/Resources/PowerQuality_book.pdf, May 16, 2002, pp. 1-12, Dip-Proofing Technologies Inc., USA.

Stratford, J., et al., Applying Voltage Dip Proofing to Provide Ride-Through, http://www.electricenergyonline.com/?page=show_article&mag=11&article=81, Feb. 2003, pp. 1-8, Electric Energy Publications Inc., USA.

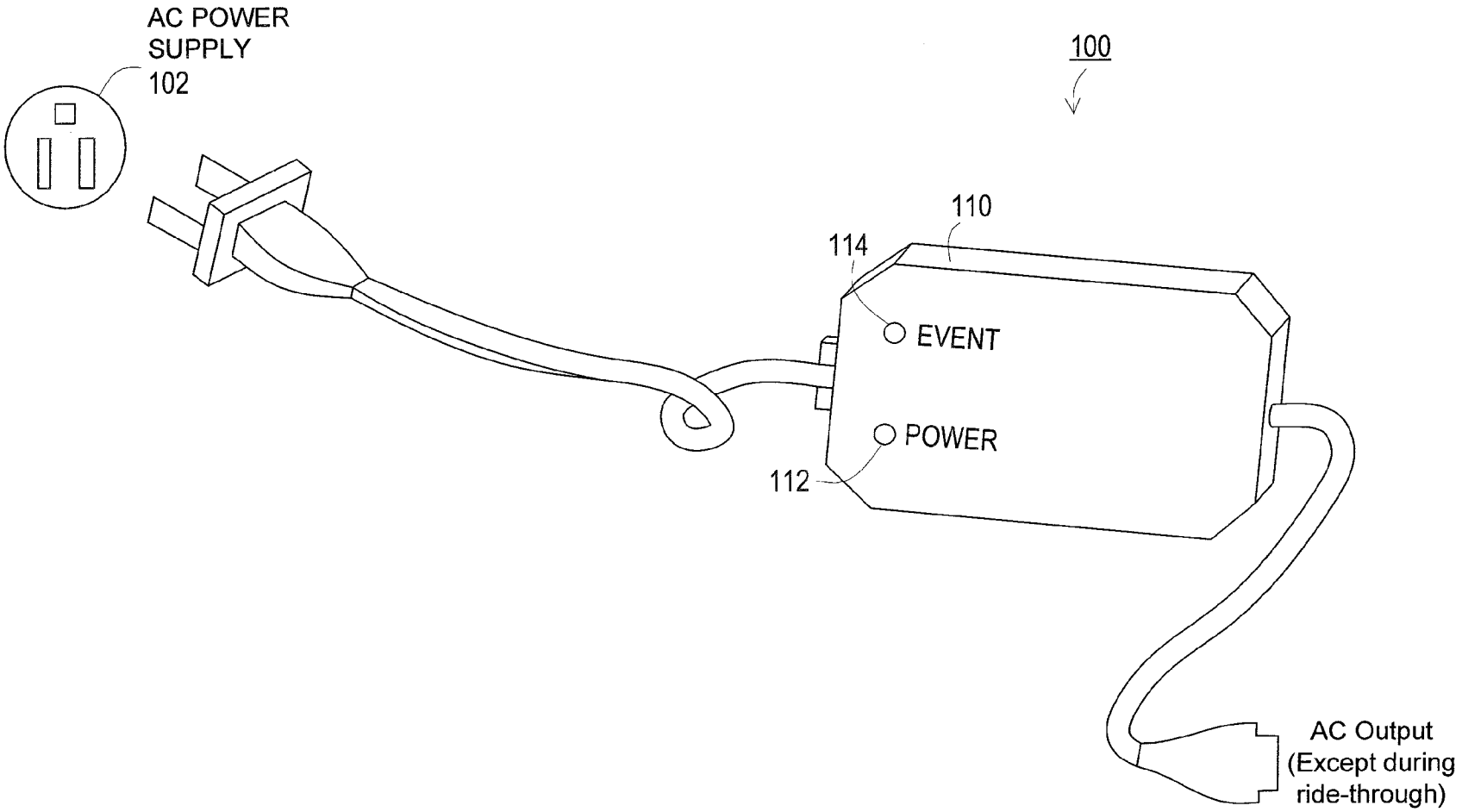
FIG. 1 EXEMPLARY LINE CORD WITH BUILT IN RIDE-THROUGH FUNCTIONALITY

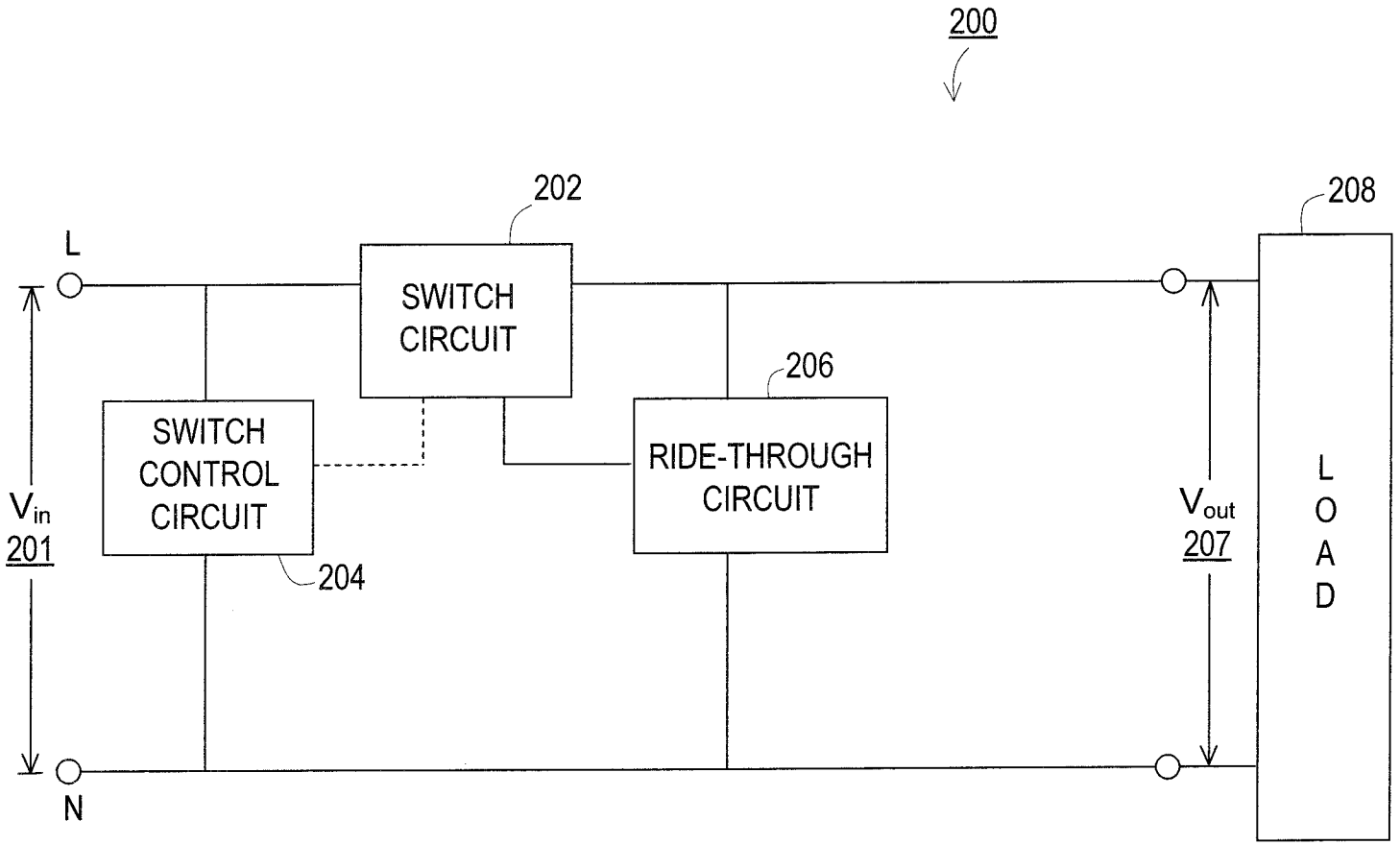
*FIG. 2* BLOCK DIAGRAM SCHEMATIC OF A CIRCUIT PROVIDING RIDE-THROUGH FUNCTIONALITY

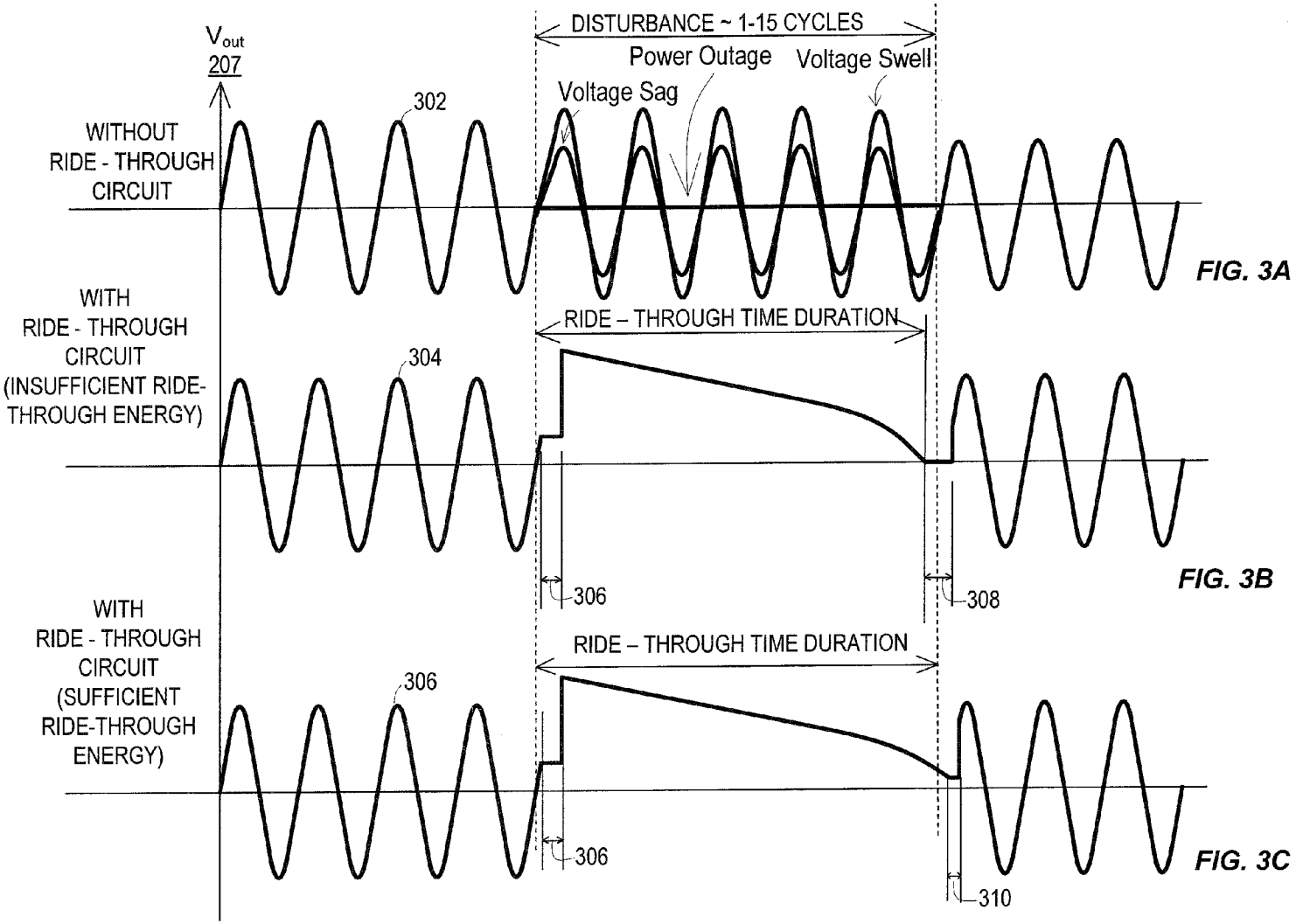
FIGS. 3A, 3B, 3C EXEMPLARY VOLTAGE WAVEFORMS AS EXPERIENCED BY LOAD

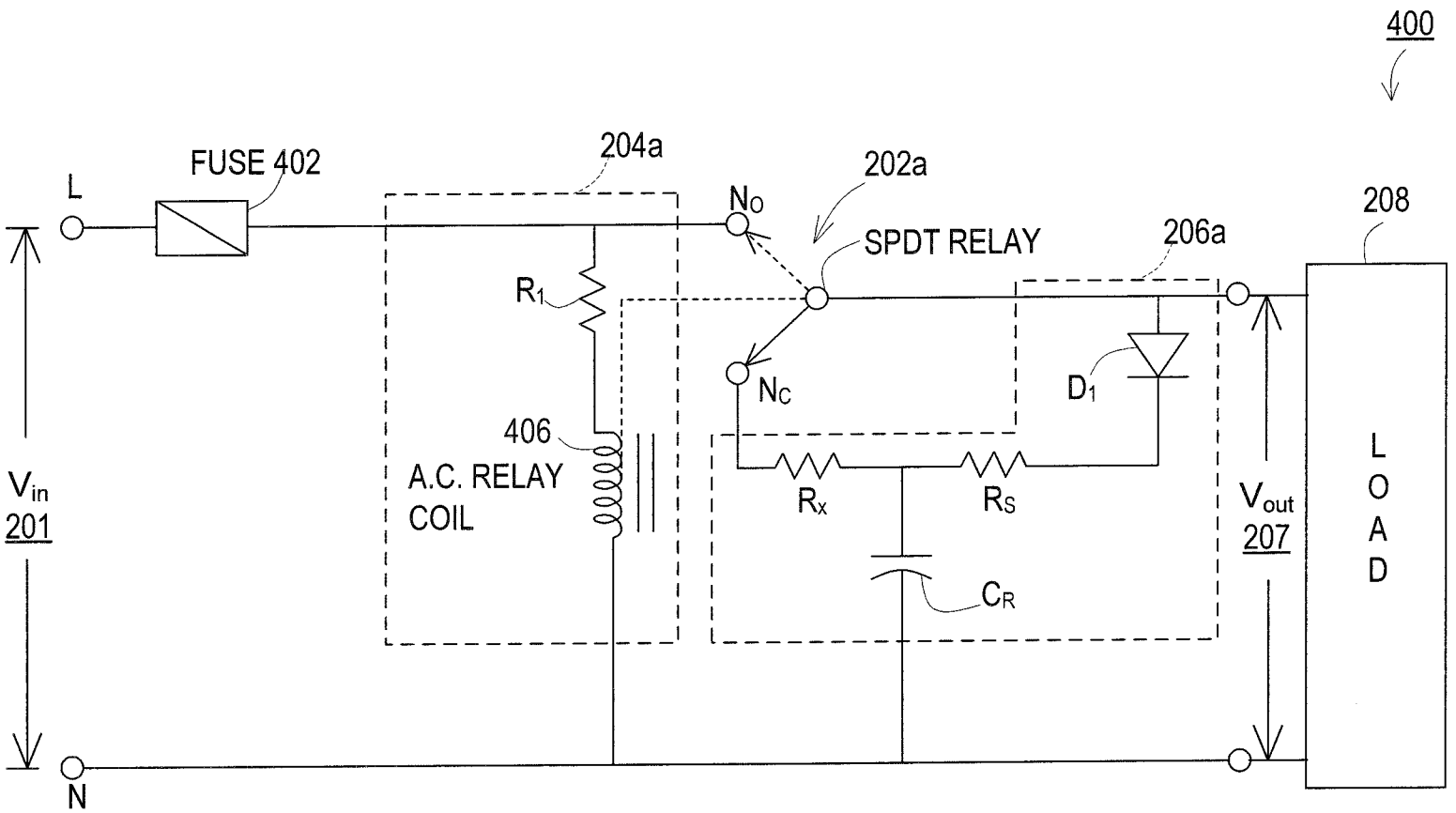
*FIG. 4* A.C. RELAY EMBODIMENT PROVIDING RIDE-THROUGH FUNCTIONALITY

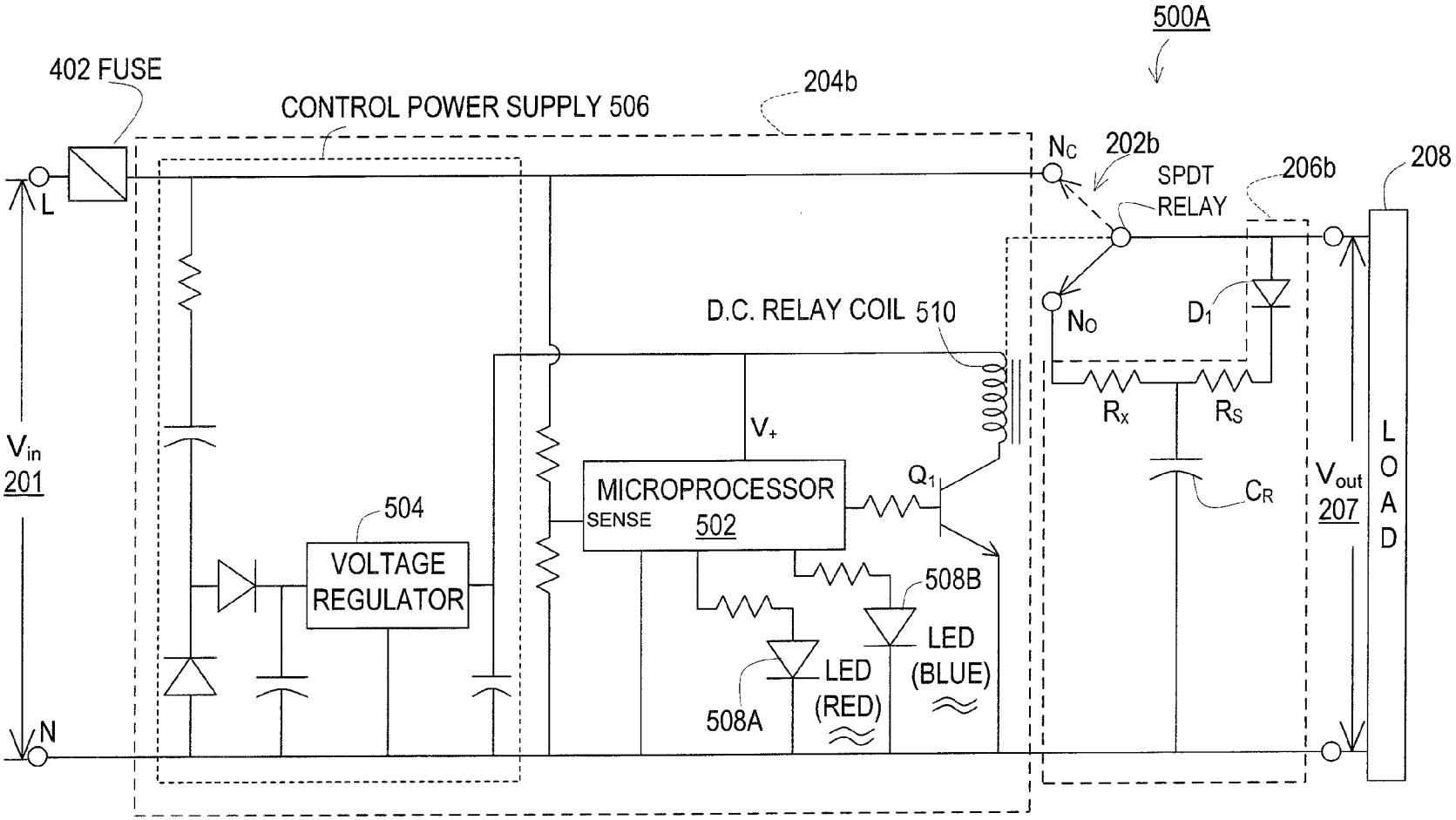
*FIG. 5A* D.C. RELAY EMBODIMENT PROVIDING RIDE-THROUGH FUNCTIONALITY (SEE FIG. 6A FOR MICROPROCESSOR STEPS)

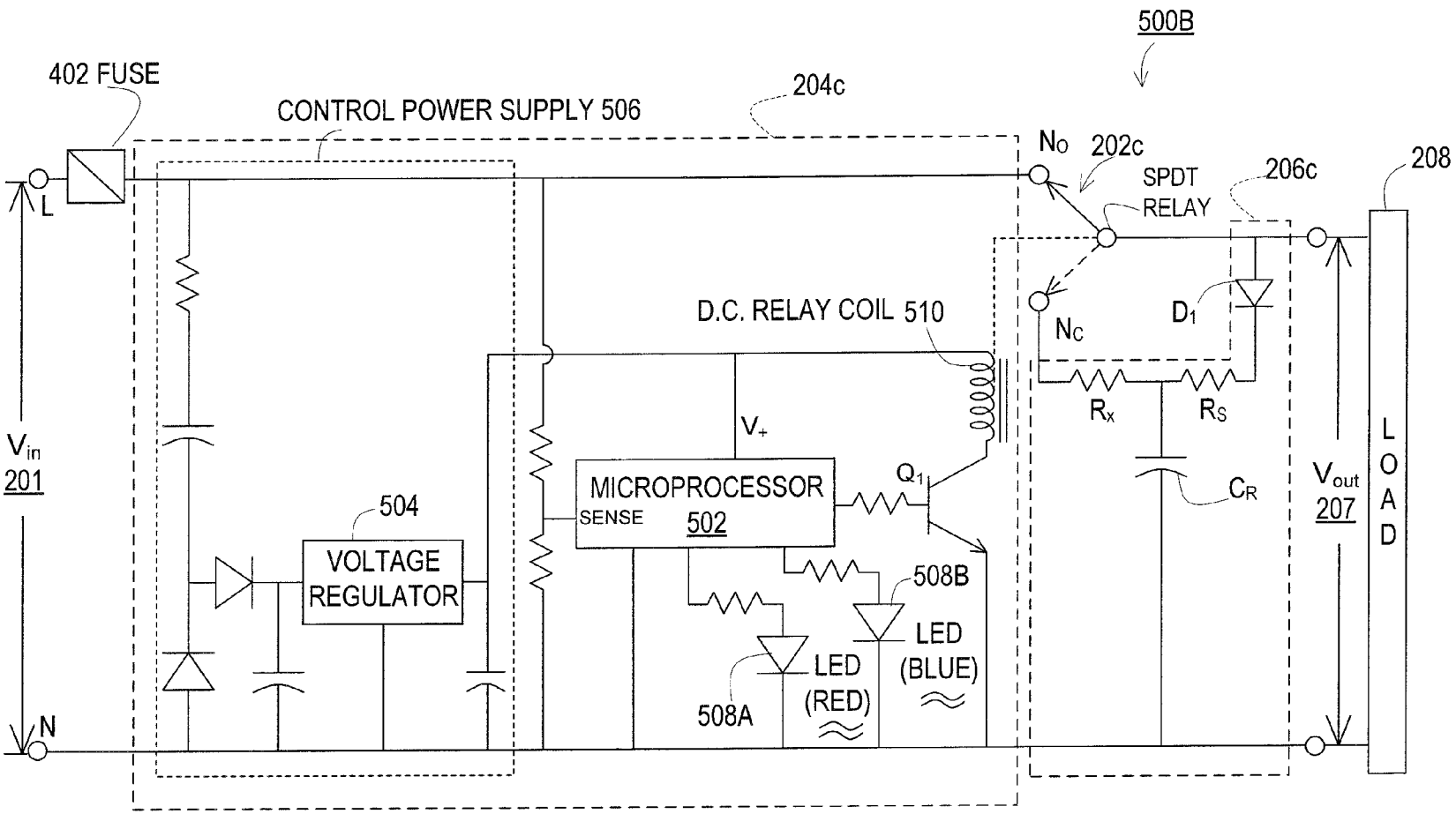
*FIG. 5B* D.C. RELAY EMBODIMENT PROVIDING RIDE-THROUGH FUNCTIONALITY WITH POWER PROTECTION AT STARTUP (SEE FIG. 6B FOR MICROPROCESSOR STEPS)

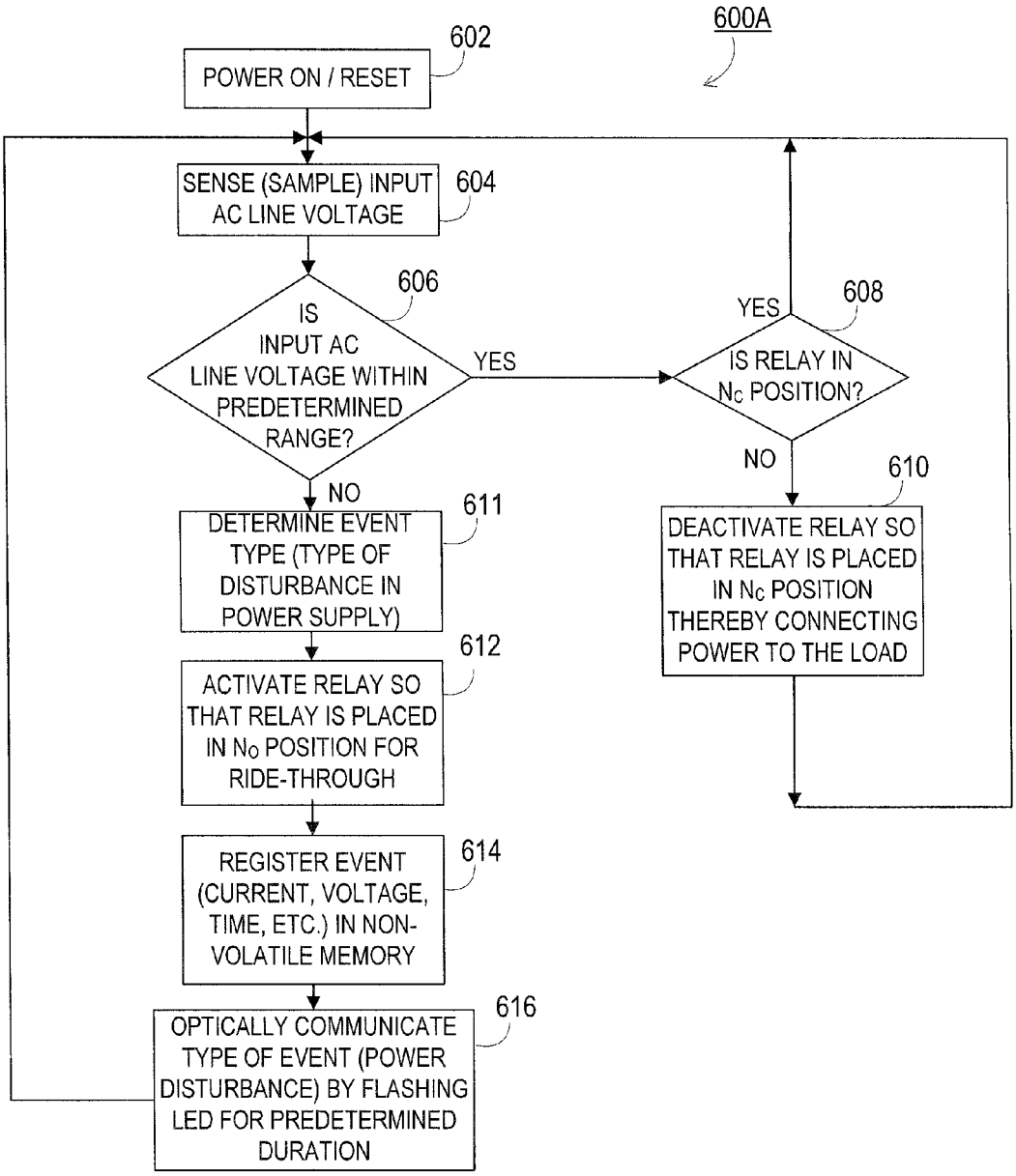
*FIG. 6A* EXEMPLARY MICROPROCESSOR STEPS (FIG. 5A EMBODIMENT)

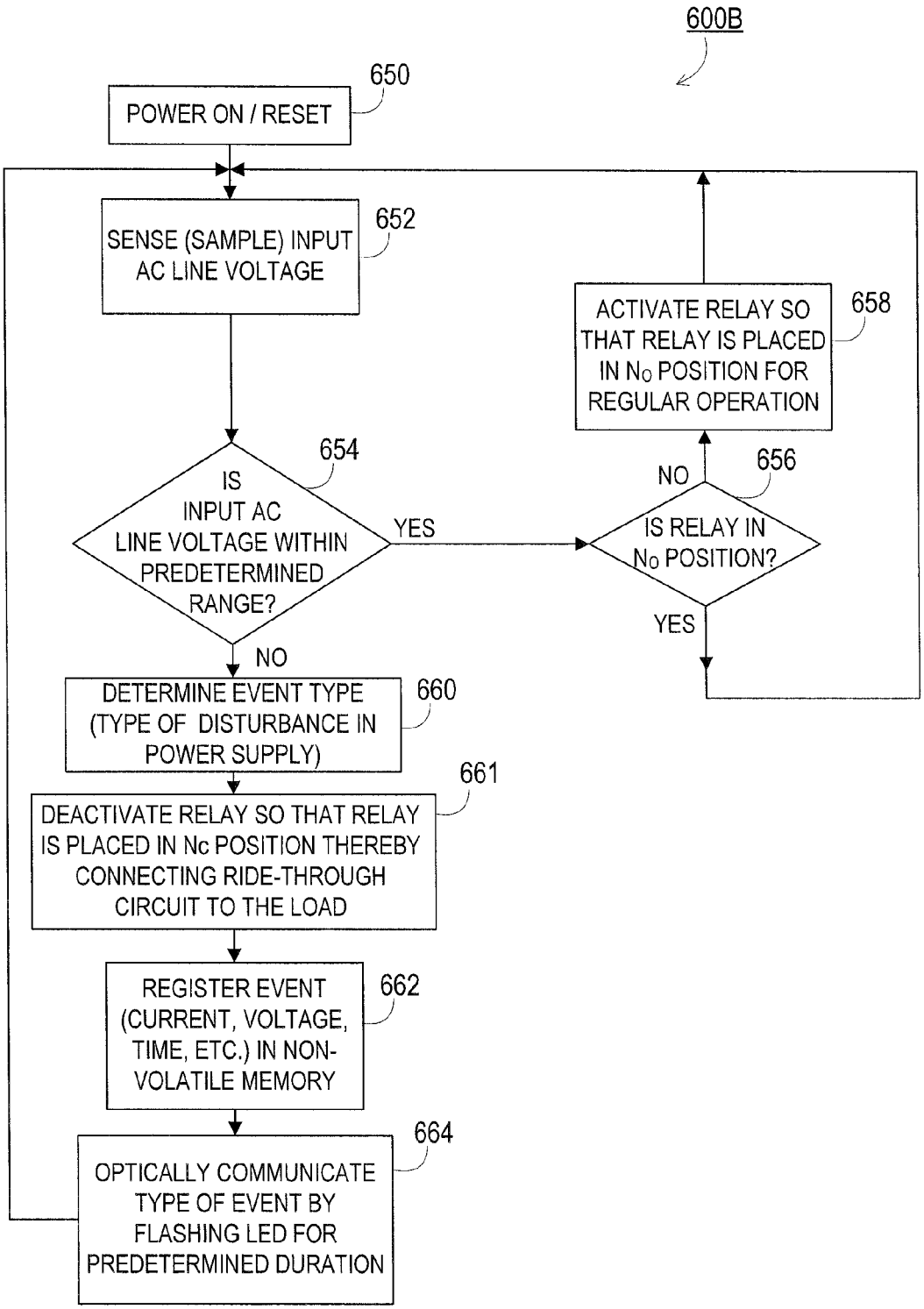
*FIG. 6B* EXEMPLARY MICROPROCESSOR STEPS (FIG. 5B EMBODIMENT)

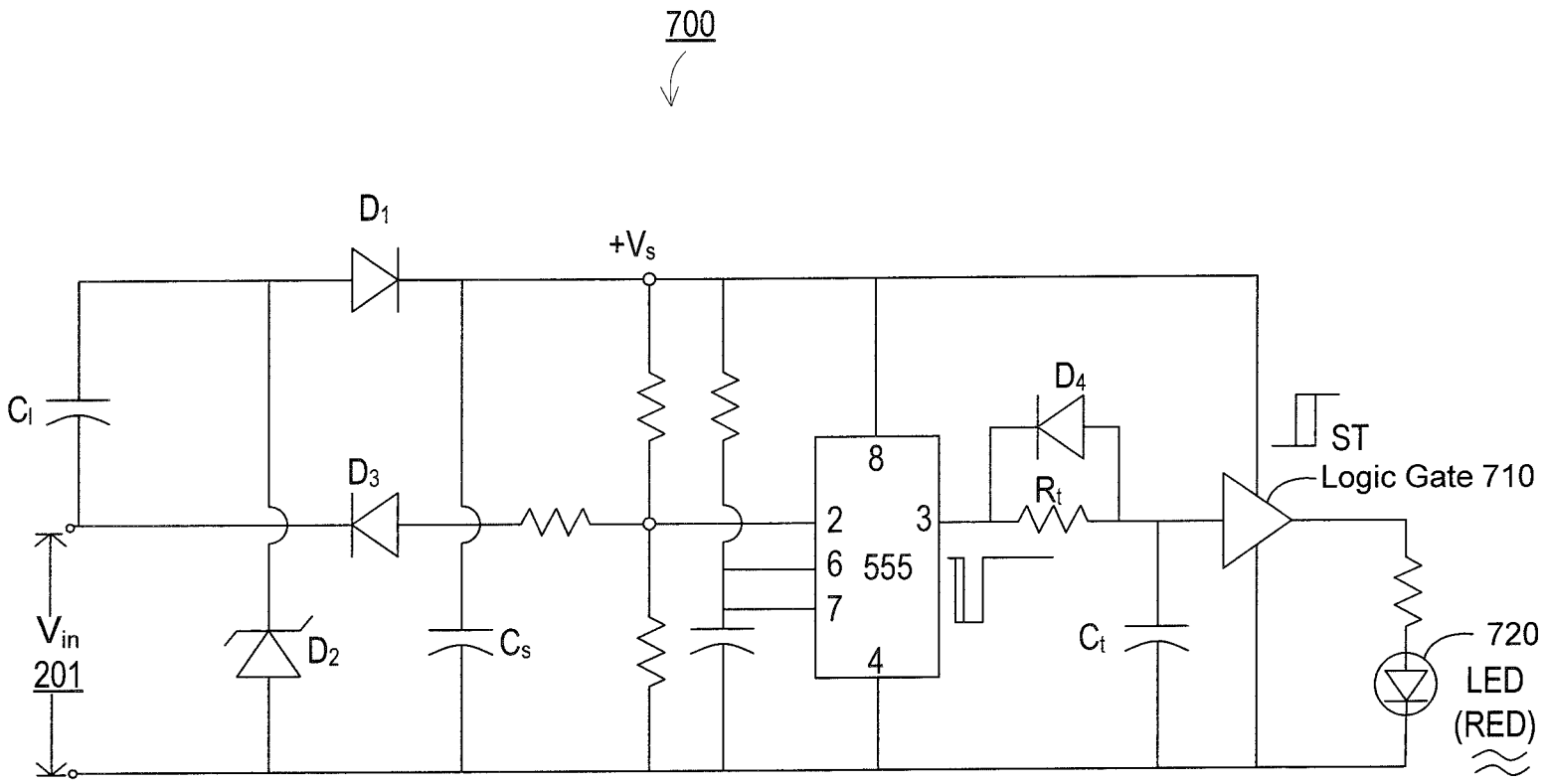
FIG. 7 INDICATOR CIRCUIT

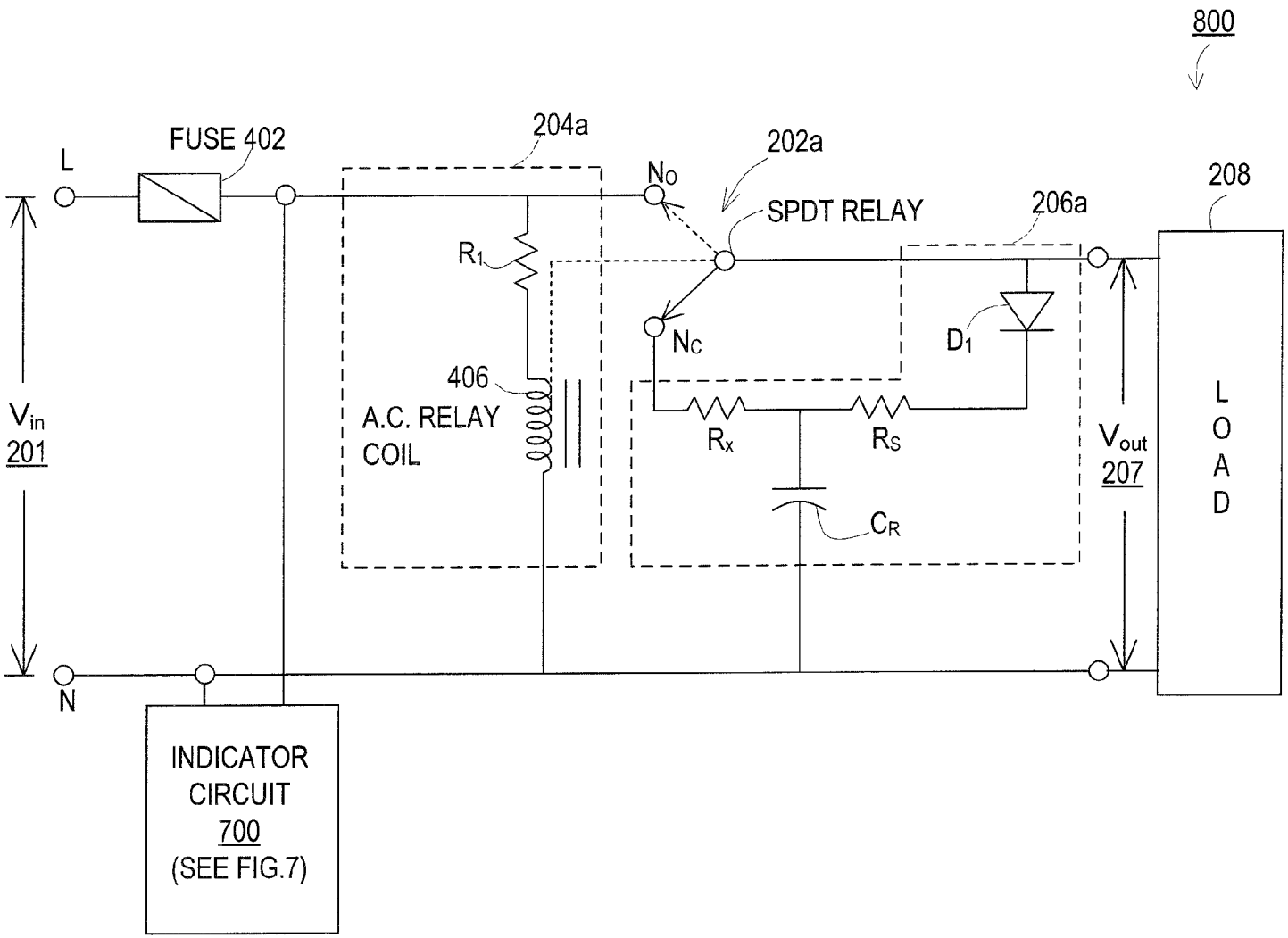
*FIG. 8* INDICATOR CIRCUIT COUPLED TO AN AC RELAY EMBODIMENT

LINE CORD WITH A RIDE-THROUGH FUNCTIONALITY FOR MOMENTARY DISTURBANCES

CROSS REFERENCE TO RELATED APPLICATION

This application claims benefit under 35 U.S.C. §119(e) of U.S. Provisional Patent Application No. 61/428,585 filed Dec. 30, 2010, and entitled "Line Cord With Smart Ride-through for Momentary Interruptions", which is incorporated herein by reference as if set forth herein in its entirety.

TECHNICAL FIELD

The present disclosure relates generally to protection of electronic devices under unexpected power line conditions, and more particularly, to an apparatus that provides a temporary ride-through during occurrence of momentary disturbances (e.g., voltage swells, voltage sags, and other types of disturbances) in the power supply that typically cause undesired lock-ups and unexpected reboots of electronic devices that includes microprocessors.

BACKGROUND

Recently, over the last decade, there has been an explosion of low-cost digital electronic devices such as digital video recorders (DVR) and cable set-top boxes. For example, according to a Nielsen survey conducted in 2008, about 90% of households in the United States have either cable or satellite services. Most of the above-mentioned devices and other similar devices generally comprise low-power digital electronics and microprocessors that have a tendency to lock-up (which needs the devices to be rebooted or reset) as a result of momentary disturbances on the power supply grid such as those arising from voltage sags, voltage swells and the like. Disturbances on the order of a quarter of a second (i.e. about 15 cycles of a 60 Hz AC power) are believed to occur frequently on the power supply grid, and are also believed to be a cause of these lockups. As will be understood, not only do lock-ups and reboots of digital video recorders (DVR) and cable set-top boxes due to power line disturbances cause damage to such devices, but even further, the interruption of service resulting from the disturbances leads to customer dissatisfaction.

Typically, voltage sags are characterized by drops of between 10%-90% of nominal (system) line voltages. The drops in voltage typically last from a cycle (16.6 millisecond) to a second or so, or tens of milliseconds to hundreds of milliseconds. Voltage swells are brief increases in voltage over the same time range. Power line disturbances resulting in longer periods of sustained low or high voltages are usually referred to as "undervoltage" (a/k/a brownouts) or "overvoltages".

As will be known, in one exemplary scenario, voltage sags are often caused by faults on the grid, and infrequently due to high starting currents drawn by motors, refrigerators, freezers, air conditioners, or other electrical loads that draw high currents at startup. Another reason for occurrence of voltage sags are faults in the power provider's transmission or distribution lines. Voltage sags occurring at high voltages typically spread through the utility system and are transmitted to lower voltage systems via transformers. Additionally, voltage sags and other momentary disturbances can occur frequently in some locations (especially locations that experience severe weather phenomenon such as lightning, wind, and ice). In other words, if, for example, lightning strikes a power line and continues to ground, this results in a line-to-ground fault. The line-to-ground fault in turn creates a voltage sag and this reduced voltage can be seen over a wide area. Similarly, in other instances, snow and ice build-up on power line insulators can cause flash-over, either phase-to-ground or phase-to-phase. Snow or ice falling from one line can cause it to rebound and strike another line. These events cause voltage sags to spread through other feeders on the system.

Voltage swells are most often caused by a line-to-ground fault on a polyphase transmission line or feeder. The line-to-ground fault causes a voltage rise on the un-faulted phases. In other instances, a voltage swell can also be caused by removing a large load or by switching in a capacitor bank that is too large for the prevailing power line conditions.

Notwithstanding the reasons for occurrence of voltage sags and voltage swells, it is generally understood that greater frequencies of disturbances of service can cause severe damage to electrical and electronic devices. Sometimes, because of their very short durations, voltage sags and swells (or, more generally short-duration power line disturbances) are typically unnoticed by customers most of the time. However, such disturbances are often manifested in terms of lock-ups of electronic devices or reboots, which can, in turn lead to customer frustration. Unfortunately and to make matters worse, customers are unable to correlate the lock-up of their electronics devices as being the outcome of these short-duration power disturbances. Rather, they perceive such lock-ups as a consequence of faulty electronic device manufacturing methods, low-quality components used in the manufacture of such devices, and/or unreliable service providers.

In particular, for some specific type of device manufacturers and/or service providers, this creates a customer relationship problem. For example, most (if not all) cable set-top box, IPTV, cable, and satellite dish-based manufacturers, including associated service providers are typically subjected to the brunt of customer wrath, frustration and angst, because most consumer home electronics (and services associated with them) lock-up in the middle of operation due to these unpredictable, short-duration power line disturbances.

Usually, satellite dish-based manufacturers and service providers address this problem by sending technicians to customers' homes for purposes of troubleshooting their electronic device. As will be understood, this results in significant service and maintenance overhead for organizations such as satellite dish-based manufacturers and service providers.

A conventional approach to the above-mentioned problem is an apparatus that stores energy (from the power line) during normal power line conditions, and that later feeds the stored energy to the load as long as the power line disturbance lasts, to synthesize normal operating conditions. When normal power line operating conditions are restored, the load is transferred back to the utility power line voltage.

The most commonly used conventional solution to the aforementioned problem is an uninterruptible power supply (UPS) with battery energy storage that provides a ride-through time of 3-5 minutes (i.e. adequate to cover most power line disturbances). However, such a solution is expensive as it involves implementation of energy storage and a DC/AC inverter with multiple switching devices and complex control circuits. Moreover, most consumers have multiple electronics devices at their homes, and as a result, using a UPS for every one of those devices would be very expensive.

Another alternate approach involves the use of a dynamic sag corrector. A dynamic sag corrector provides 3-12 cycles of ride-through for AC loads served, protecting against momentary disturbances. While this eliminates the battery, and the corresponding limitation in life, this is still an expensive solution as it still requires a DC/AC inverter, bypass switch, and control circuits. However, as will be understood the above-mentioned approaches (e.g., such as using a UPS or a dynamic sag corrector) that exist in the present art are proven approaches that are most suited in industrial and commercial environments (such as factories, offices, stores, shops, etc.), wherein power levels consumed by electrical/electronic loads installed therein typically vary in the range from 1 kW to over 2000 kW. On the other hand, most home electronics equipment (devices) operate in the power range between tens of watts to at most, the hundreds of watts. Therefore, for such equipment the above-mentioned approaches would not work. Therefore, for such consumer equipment the above-mentioned approaches are expensive as they involve energy storage and complex circuit components.

Therefore, there is a long-felt need for a cost-effective solution applicable in consumers' homes that protects consumers' electronics devices during frequent short duration (momentary) power line disturbances by providing ride-through electrical energy, thereby preventing problems such as lock-ups and reboots. An apparatus constructed in accordance with aspects of such a solution needs to be compact (small form factor), portable, inexpensive, and will be placed between an electronic device and the AC power supply line. It will be even beneficial if such an apparatus is also able to provide diagnostic feedback to the consumer, and also conceivably to the device manufacturer, and/or the service provider, of the occurrence of a type of disturbance that resulted in the problems. Such an apparatus would prevent damage to electronic devices, reduce consumer angst, and improve levels of customer service and satisfaction. Not only so, the apparatus will also be able to detect various types of power-line disturbances and provide indication accordingly so that additional attention can be given, or, trouble shooting/servicing can be done.

BRIEF SUMMARY

Briefly described and generally stated, aspects of the present disclosure relate to an apparatus and methods for providing a ride-through during occurrence of momentary disturbances (e.g., voltage swells, voltage sags, power outages and other types of disturbances) in the power supply. In the disclosed embodiments, such an apparatus includes capacitors, diodes, resistors, switches, and various other components. Typically, the choice of various components used in the apparatus relies on the assumption that the disturbance does not exceed a predetermined time duration, for example, 1-15 voltage cycles, or any other time duration as deemed relevant.

According to an aspect, the apparatus disclosed herein draws AC power from an AC power supply source and provides AC power at the output of the apparatus, except during a ride-through when temporary electrical power is supplied by a ride-through capacitor included as part of the apparatus. This facilitates in preventing undesired lock-ups and unexpected reboots of loads (electronic devices) that includes microprocessors. The ride-through capacitor is chosen based on the power requirements of the load and the duration of ride-through desired.

According to another aspect, the apparatus includes a switch (e.g., an electromechanical relay) that disconnects the load from the electrical power supply during a disturbance and connects the load to the ride-through capacitor. When normal line conditions are restored, the switch is actuated in a manner such that the load is re-connected back to the electrical power supply.

In the disclosed embodiments, the switch is actuated by transmitting a control signal to an AC relay coil or a DC relay coil. For embodiments involving DC relay coils, the control signal is provided by a microprocessor that senses (samples) the AC line voltage or, some representative value of the AC line voltage. The voltage sensed by the microprocessor is used in conjunction with microprocessor logic to determine whether or not, disturbances are occurring in the power supply. In the event that disturbances occur, and according to an exemplary aspect, the microprocessor identifies a type of disturbance with the voltage sensed by the microprocessor. For example, if the voltage sensed by the microprocessor lies between a first threshold and a second threshold, then one particular type of disturbance is indicated. Alternately, if the voltage sensed by the microprocessor lies between a second threshold and a third threshold, then another particular type of disturbance is occurring, and so on.

Further, in alternate embodiments, indicator circuits included as an added feature to the apparatus disclosed herein are used to provide visual feedback of the type of disturbance to users, even after the disturbance ceases to exist. For example, a multi-purpose light (powered by multiple LEDs) can have a first specific number of flashes or blinks corresponding to a voltage sag, a second specific number of flashes corresponding to a voltage swell, etc. It will be understood that such indicator circuits can be used in various embodiments of the disclosed apparatus involving both AC relay coils as well as DC relay coils.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more non-limiting and non-exhaustive embodiments of the present disclosure, and, together with the written description, serve to explain the principles of the disclosure. Wherever possible, the same reference numbers are used throughout the drawings to refer to the same or like elements of an embodiment, and wherein:

FIG. 1 illustrates an electrical line cord that includes a ride-through circuit, according to one embodiment of the present disclosure.

FIG. 2 shows a block diagram of a circuit providing a ride-through functionality, with a ride-through circuit connected between an input AC line and an electrical load in addition to a switch circuit and a switch control circuit that are configured to operate in conjunction with the ride-through circuit, according to one embodiment of the present disclosure.

FIG. 3 (consisting of FIG. 3A, FIG. 3B, and FIG. 3C) shows exemplary output voltage (appearing across the electrical load) waveforms with and without usage of a ride-through circuit between an input AC line and an electrical load.

FIG. 4 shows an exemplary AC relay circuit comprising an AC relay control circuit that is configured to operate in conjunction with a ride-through circuit, according to one embodiment of the present disclosure.

FIG. 5A shows an exemplary DC relay circuit comprising a DC relay control circuit that is configured to operate in conjunction with a ride-through circuit, according to one embodiment of the present disclosure.

FIG. 5B shows an exemplary DC relay circuit comprising a DC relay control circuit that is configured to operate in conjunction with a ride-through circuit, wherein the exemplary circuit provides protection to the load at startup, according to an alternate embodiment of the present disclosure.

FIG. 6A is a flowchart showing an exemplary microprocessor-implemented process 600A corresponding to various steps executed in the microprocessor logic as followed in the embodiment shown in FIG. 5A.

FIG. 6B is a flowchart showing an exemplary microprocessor-implemented process 600B corresponding to various steps executed in the microprocessor logic as followed in the embodiment shown in FIG. 5B.

FIG. 7 shows an exemplary indicator circuit involving a 555 timer IC connected to at least one LED for visually communicating disturbances in the power supply line, according to one embodiment of the present disclosure.

FIG. 8 shows an exemplary circuit comprising the exemplary AC relay circuit (shown previously in FIG. 4) coupled to the indicator circuit (shown previously in FIG. 7), according to one embodiment of the present disclosure.

DETAILED DESCRIPTION OF DISCLOSED EMBODIMENT

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates.

Aspects of the present disclosure relate to devices and methods that provide a ride-through during power line disturbances. According to one aspect, such ride-through functionality is provided for momentary disturbances that last for about 10-15 cycles of the input AC signal. In other words, for a 60 Hz input AC signal, the ride-through typically lasts 0.16-0.25 seconds.

Additionally aspects of the present disclosure relate to connecting switch circuits and switch control circuits between an input AC signal and a load, wherein generally the switch control circuit cuts off power to the load when the voltage in the input AC signal goes below a certain predetermined threshold. In one aspect, switch circuits comprise electromechanical relays for cutting off power to the load.

Further, aspects of the present disclosure relate to providing a ride-through circuit that provides power temporarily to the load during a ride-through period. Even further, such a ride-through circuit includes one or more electrical components that charge from the input AC line, storing the charge which is ultimately delivered as electrical energy to the electrical load during the ride-through period.

Referring now to the figures, FIG. 1 illustrates an overview 100 of an embodiment of an exemplary line-cord with built-in ride-through functionality. As will be apparent to one of ordinary skill in the art, many electronics devices are powered by a detachable two or three pin line cord which provides a standard interface for connection to a power source. As shown in FIG. 1, usually such a line-cord includes a ride-through housing unit 110 that connects to an input AC power supply 102 for providing AC power to a load (not shown in FIG. 1).

As will be understood, an AC power supply 102 are rated to provide 120 V, 240 V, or other voltages in conjunction with an associated current that depends on the current drawn by a particular type of connected load. As will be known by those skilled in the art, various electrical components such as (by way of non-limiting examples) plugs, sockets, connectors associated with a line cord and accordingly, power supplies 102 depend on national standards that differ from one country to another, or even from one electronic device to another. It will be understood that embodiments of the present disclosure are applicable universally to all kinds of power supplies, and not necessarily limited to 120V or 240V, as discussed herein. Further, it will be understood that a line cord (e.g., as shown) in FIG. 1 can be designed to operate a particular type of electronic home equipment (e.g., DVR, set-top box etc.), or alternately in some embodiment, one generic line cord can be used to operate a variety of electronic home and/or office equipment.

The ride-through circuit housing unit 110, in one aspect, provides visual diagnostics/feedback corresponding to the condition of the power supply, i.e. input AC line condition. In one embodiment, the ride-through circuit housing unit 110 comprises at least two (2) distinct display lights, e.g., light 112 (labeled POWER) indicates whether the ride-through circuit housing unit 110 is receiving nominal power from the input AC line under normal line operating conditions, and another multi-purpose light 114 corresponding to visual indications of specific events (such as power anomalies) detected in the input AC line. For example, the multi-purpose light 114 can have a first specific number of flashes or blinks corresponding to an overvoltage condition, a second specific number of flashes corresponding to a undervoltage condition, a third specific number of flashes corresponding to a voltage sag, and so on. It will be apparent to one ordinarily skilled in the art that the ride-through circuit housing unit 110 (in one embodiment) detects a present state or disturbance of the input AC line, and further classifies such a state into a specific types of event, e.g. voltage swell, voltage sag, power outage, etc. In the disclosed embodiment the ride-through circuit housing unit 110 includes a ride-through circuit that generally provides temporary power to an electrical load during short-duration disturbances in the power supply (see e.g., FIGS. 2, 3A, 3B, 3C). The temporary power is typically provided by a slowly discharging capacitor that gets charged from the power supply during normal operating conditions of the power supply. Exemplary ride-through circuit embodiments will be described in detail in connection with FIGS. 2, 4, 5A, and 5B. Therefore, it will be understood and appreciated that embodiments (including a line cord for example, as shown in FIG. 1) of the present disclosure provides AC output to an electronic device and draws AC power as input from a power supply, except during a ride-through time interval when temporary power is provided to a load by a slowly discharging capacitor. This, and various other aspects of the claimed invention(s) will be better understood in the discussions that follow herein.

Before proceeding further, it is noted herein that although the present disclosure discusses a ride-through functionality implemented inside a line cord (more particularly, a ride-through circuit housing unit included therein), it will be understood that in alternate embodiments, a ride-through functionality can be implemented in different circuit elements depending on the requirements of the connected load. For example, ride-through functionalities can be implemented in (but not limited to) electrical power supplies such as switched mode power supplies (SMPS) inside electronic devices, power protection strips or surge protectors, and various other circuit elements as will occur to those skilled in the art.

Referring to FIG. 2, a block diagram of a circuit 200 is shown providing a ride-through functionality to an electrical load 208. In one embodiment, the electrical load 208 comprises low power electronic devices such as DVRs and set-top boxes that typically have power consumption in the range of 20-100 watts. As shown in FIG. 2, in one embodiment, the circuit 200 comprises a relay control circuit 204, a relay circuit 202, and a ride-through circuit 206. In one aspect, the relay control circuit 204 is connected between the input AC line voltage ($V_{in}$) 201 and is used to operate a relay circuit 202. The relay circuit 202 provides a conduction path for connecting the load 208 to the input AC line voltage ($V_{in}$) 201. As will be understood, in one aspect, electrical components included within ride-through circuit 206 provide ride-through functionality. It will be understood that the term "ride-through circuit" as used herein is for explanation and illustration purposes. It is not intended to be limiting in any way, shape, or form. Specific examples characterizing particular circuit components that comprise the relay control circuit 204, the relay circuit 202, and the ride-through circuit 206 will be explained in connection with FIGS. 4, 5A, and 5B. As shown in FIG. 2 and other figures herein, the voltage 207 appearing across the electrical load 208 is labeled as $V_{out}$.

Due to the occurrence of a disturbance in the power supply, e.g., a voltage sag, the input AC line voltage ($V_{in}$) 201 falls below a predetermined threshold as determined by a relay control circuit 204, and consequently, the relay control circuit 204 actuates an electromechanical relay (not shown in FIG. 2) that typically is included in relay circuit 202, to disconnect the load from the input AC line until such time duration when the input AC line voltage is restored back to nominal levels. According to one aspect, a relay control circuit 204 comprises an AC relay coil (e.g., as shown in FIG. 4) or DC relay coils (e.g., as shown in FIG. 5A and FIG. 5B).

According to another aspect, the circuit 200 (or, other embodiments of the circuit) include voltage clamping devices for providing protection against high-voltage surges such as that caused due to lightning. In one example, voltage clamping devices include metal-oxide varistors (MOV) that are not shown in any drawings accompanying this disclosure.

According to other aspects of the present disclosure, the electrical load 208 is disconnected from the input AC line voltage 201 when the input AC line voltage 201 falls outside the nominal bounds. In one exemplary aspect, a ride-through circuit 206 disconnects the electrical load from the input AC line voltage 201 when the input AC line voltage 201 is below a predetermined threshold. According to another aspect, a ride-through circuit 206 comprises diodes included as a part of an AC/DC rectifier that is further connected to an electrolytic capacitor. It will be understood that the use of AC/DC rectifiers allow the input AC line voltage to be of any arbitrary voltage polarity without impacting operation of the electrical load. Also, as will be understood (e.g., from FIGS. 4, 5A, and 5B) one or more reverse-biased diodes included as a part of an AC/DC rectifier in ride-through circuit 206 prevents electric charge stored in the electrolytic capacitor from returning back to the power supply.

While the input AC line voltage ($V_{in}$) 201 lies within nominal operating bounds, (e.g., between 80V and 140V), the load stays connected to the input AC line voltage ($V_{in}$) 201. During such normal operating conditions, an electrolytic capacitor (not shown in FIG. 2) that is included in the ride-through circuit 206 is charged from the input AC line voltage. The stored charge in the electrolytic capacitor provides the ride-through functionality needed as will be better understood from the discussions below and also in FIGS. 4, 5A, 5B, 6A, and 6B. Thus, in one example, a quick analysis will indicate that if the predetermined threshold is 80V and the normal line operating voltage is 150V, then, to provide a ride-through of about 1 second duration to a load that consumes 30 Watts, an electrolytic capacitor of about 3700 microFarads is used. Further, it will be understood that such analysis reveals that the time duration of the ride-through is linearly dependent on the size of the electrolytic capacitor and inversely varies with the current consumed by the load.

For most electrical loads, a switched mode power supply (SMPS) is pre-connected (typically by manufacturers) at the input power stage of an electrical load (not shown in the accompanying drawings), wherein the switched mode provides a power conditioning functionality by making the load compatible with the AC line voltage. When the input AC line voltage 201 is below a predetermined threshold as detected by a relay control circuit 204, the relay control circuit 204 sends a signal to the relay circuit 202, thereby actuating a relay such that the electrical load 208 gets disconnected from the input AC line voltage 201. This means that even though the load 208 is no longer receiving an AC line voltage, the presence of the AC/DC rectifier and switched mode power supply inside the device being protected prevents misoperation, allowing normal operation to be maintained.

It will be understood by one skilled in the art that typical electronic devices (e.g., electrical loads 208) continue to operate even at voltages as low as 50V or as high as 130V, suggesting that they could be disconnected from the AC line voltage, and instead continue to draw power from a discharging electrolytic capacitor that is included in the ride-through circuit 206, and thus maintain proper operation for a limited duration. If the AC line voltage 201 recovers before the capacitor voltage has decayed to levels that cause the electrical load 208 to stop operating, the electrical load 208 will continue to operate without interruption. The energy needed to provide operate the electrical load 208 momentarily without interruption, e.g., a ride-through function, is stored in an electrolytic capacitor (not shown in FIG. 2), which is charged from the input AC line voltage in the ride-through circuit. Additionally, diodes included in a ride-through circuit 206 remain forward-biased relative to the electrical power supply such that an uncharged capacitance gets charged from the electrical power supply through the diode and a resistance. But the diode becomes reverse-biased once the capacitance gets fully charged, thereby preventing electrical charge stored in the capacitance from returning back to the input AC line.

During a ride-through period, the capacitor provides electrical energy to the electrical load 208, discharging the capacitor in the process, typically through a small resistance (not shown) that is also included in the ride-through circuit. This energy is delivered to the load as a decaying DC voltage, which is then rectified by the power supply inherent built inside the load, and is used to allow ride-through of the load. It will be understood that in alternate aspects, a ride-through circuit 206 can comprise more than one capacitor, in addition to various other circuit components as will occur to one skilled in the art. Furthermore, according to alternate aspects, the relay circuit comprises a selectively actuable switch that is controlled by a switch control circuit (referred to in FIG. 2 as a relay control circuit). Exemplary non-limiting circuit embodiments corresponding to these alternate aspects have been illustrated in FIGS. 4, 5A, and 5B.

Now referring to FIG. 3, exemplary output voltage (appearing across the electrical load) waveforms are shown, corresponding to scenarios with and without usage of a ride-through circuit between an input AC line and an electrical load. Particularly, waveform 302 (FIG. 3A) illustrates exemplary disturbances (such as, voltage sags, voltage swells, and power outages) in the power supply that are of short-duration, e.g., lasting about 1-15 cycles.

It will be understood that for purposes of example and explanation in this disclosure, it has been assumed that the disturbances in the power supply last 1-15 cycles, or, generally a predetermined number of cycles. Such an assumption of a disturbance lasting a predetermined number of cycles is generally utilized in design considerations of the ride-through circuit that provides ride-through for a targeted maximum duration of a disturbance. Particularly, in one example, the value of the capacitor in the ride-through circuit is selected based on the assumption of a targeted maximum duration of a disturbance given the expected load current during that duration. Therefore, as referred to herein, disturbances in the power supply that are momentary, or, in other words, disturbances that last a short duration of time (e.g., lasting about 1-15 cycles or some other predetermined number of cycles) have been considered. However, time duration of voltage sags, voltage swells, and power outages can vary. For example, in many scenarios, power outages can last longer than 15 cycles. As will be understood by one skilled in the art that the ride-through energy depends on load current, and a targeted maximum duration of a disturbance such as voltage sags, voltage swells, and power outages.

Voltage sags are characterized by drops of between 10%-90% of nominal (system) line voltages. Voltage swells are brief increases in voltage over the same time range, e.g., lasting about 1-15 cycles. Power outages are characterized by zero voltage, or, almost zero values of voltage, in the output voltage 207 as experienced by a load. Therefore, FIG. 3A illustrates voltage waveforms (for various types of disturbances, such as voltage sags, voltage swells, and power outages) as experienced by the load in scenarios wherein a ride-through circuit is not employed.

Alternately, waveform 304 (FIG. 3B) and waveform 306 (FIG. 3C) correspond to the output voltage 207 appearing across the electrical load 208, with usage of a ride-through circuit, utilized and constructed in accordance with aspects of the disclosure as described herein. As shown in FIG. 3B, waveform 304 corresponds to an exemplary scenario wherein ride-through functionality is provided by a ride-through circuit for a time duration that is shorter than the duration of the disturbance in the power supply. However, waveform 306 (FIG. 3C) corresponds to an exemplary scenario wherein the duration of ride-through lasts almost as long as the disturbance in the power supply.

Typically, and as recited previously, it is shown in FIGS. 3B and 3C that the voltage is still delivered to electronic loads even in the presence of short-term disturbances in the power supply, ensuring that service is maintained. It will be recalled that this voltage (during the ride-through period) is delivered from an electrolytic capacitor whose charge decays with time, as shown exemplarily in FIGS. 3B and 3C. As will be apparent to one skilled in the art, in many scenarios, the charge stored in the electrolytic capacitor may not be sufficient to last the entire time a power disturbance lasts. Thus, in such scenarios, the output voltage 207 as experienced by a load during a power disturbance correspond to the exemplary waveform 304 (FIG. 3B). On the other hand, if the charge stored in the electrolytic capacitor is sufficient to last the entire time a power disturbance lasts, then the output voltage 207 as experienced by a load during a power disturbance correspond to the exemplary waveform 306 (FIG. 3C).

Further, it is shown that the ride-through functionality is actuated after a typically short time interval 308 when ride-through energy is not sufficient, or, 310 corresponding to a scenario wherein ride-through energy stored in the capacitor is sufficient. As will be apparent to one skilled in the art, the duration of the time interval 308, (or, 310) depends on the response time of the relay and the precision in timing of the relay control circuit. Also, it is shown in FIG. 3 that at the end of a ride-through, normal conditions are restored after another typically short duration of time 308 (or, 310) that also depends on the response time of the relay and the precision in timing of the relay control circuit. In one aspect, normal conditions are preferably restored at a zero crossing point of a cycle of the input AC line voltage to protect against inrush current. (Details of systems and methods involved in reducing inrush currents after a voltage sag have been disclosed in U.S. Pat. No. 8,039,994, which is incorporated herein by reference.) In another aspect, normal conditions are restored at an intermediate point (i.e., not a zero crossing point) of a sinusoidal cycle of the input AC line voltage. As will be understood from the discussions that follow next, an AC relay circuit can be used to provide ride-through functionality.

Now turning to FIG. 4, an embodiment of a ride-through circuit 400 providing ride-through functionality in association with an AC relay coil is shown. As will be understood, this circuit will allow ride-through functionality caused due to momentary disturbances in the power supply, such as voltage sags and voltage swells. As shown in FIG. 4, the circuit 400 comprises a switch control circuit 204*a*, a switch circuit 202*a*, and a ride-through circuit 206*a*.

According to one embodiment of the present disclosure, a switch control circuit 204*a* comprises a resistance $R_1$ connected in series with an AC relay coil (e.g., as shown in FIG. 4), such a switch control circuit being connected across the input AC line voltage ($V_{in}$) 201. According to one aspect, resistance $R_1$ causes a voltage drop of the input AC line voltage 201, and thereby provides a certain degree of protection to the AC relay coil 406. It will be understood that in alternate embodiments, the resistance $R_1$ is not used in the circuit 400.

According to another aspect of the present disclosure, a relay circuit 202*a* (e.g., as shown in FIG. 4) comprises a single-pole double-throw (SPDT) relay that is configured to be placed in either one of two positions, $N_o$ or $N_c$. As will be understood, in the $N_o$ position the relay causes a path of flow of current between the load and the input AC line. On the other hand, in the $N_c$ position, the SPDT relay connects a ride-through circuit 206*a* to the load. In yet another aspect, and as shown in FIG. 4, the ride-through circuit 206*a* comprises a capacitor $C_R$, resistors $R_x$ and $R_s$, and a diode $D_1$.

In one embodiment, the AC relay coil 406 is used to actuate (engage) a SPDT relay that is normally (when the input AC line voltage 201 is within nominal bounds) in the at-rest state (for example, at a $N_o$ position as shown in FIG. 4). Consequently, the load is connected to the input AC line voltage 201, causing the capacitor $C_R$ to be charged through diode $D_1$ and the resistor $R_s$. If the AC line voltage drops 201 below outside predetermined nominal bounds (e.g., 80V and 140V), the relay switches to the $N_c$ position, disconnecting the electrical load 208 from the input AC line voltage 201, but coupling the capacitor $C_R$ to the load, wherein the capacitor $C_R$ provides the ride-through function needed. The capacitor is usually chosen depending on the time of ride-through needed, which normally is less than 1-2 seconds. As will be understood, reverse-biased diode $D_1$ prevents electric charge stored in the capacitor $C_R$ from returning back to the power supply. In an exemplary embodiment of an AC relay circuit for providing ride-through, can further provide visual feedback to users with the help of an indicator circuit. An example of an indicator circuit (comprising a 555 timer IC) is shown in FIG. 7. Also, an AC relay circuit coupled to the indicator circuit of FIG. 7 is illustrated in FIG. 8.

As will be understood, commercially available AC relay coils have variable characteristics that affect the point at which the relay contacts will open or drop out. Characteristics that affect relay operation include a number of missing cycles in the AC line voltage and the value of the resistor $R_1$. These characteristics also include the extent and duration of a disturbance such as a voltage sag. Therefore, for use in the above-described embodiment, such types of AC relay coils are chosen such that the characteristics of the AC relay coil respond to a disturbance (e.g., a voltage sag or a power outage). In other words, the AC relay coil is typically selected with predetermined current, voltage, and/or other electrical ratings to correspond to predetermined nominal voltage/current bounds and typical ride-through characteristics. Thus, alternate embodiments which allow more leniency with regard to selection of relays might be desirable in many scenarios. Such embodiments are described next herein.

Alternately, for more precise ride-though control, ride-through functionality can be provided if in an embodiment involving a ride-through function, the relay that creates a connection between the input AC line voltage and the electrical load is controlled via a DC coil, wherein the DC coil, in turn, is controlled by a microprocessor. Such an embodiment, as will be understood will provide precision time variability in control of the relay. As will be understood, in response to a change in the condition of the input AC line voltage, response time (e.g., time to activate/deactivate) of a relay should typically be fast. Typically, a microprocessor-controlled DC relay can be controlled more precisely than an AC relay coil (as shown in FIG. 4). Although an AC relay is typically cheaper in cost than a DC relay, in many scenarios the benefits of the microprocessor controlled DC relay outweigh the cost difference in the relay.

Turning now to FIG. 5A, an exemplary circuit 500A comprising a DC switch control circuit 204*b* that is configured to operate a DC relay coil in conjunction with a ride-through circuit 206*b* is shown. As shown, the switch circuit 202*b* comprises a SPDT relay. Also, the switch control circuit 204*b* comprises a microprocessor and a DC relay coil connected to a control power supply 506. As recited previously, the ride-through circuit 206*b* (comprising diode $D_1$, resistors $R_x$ and $R_s$, and capacitor $C_R$) provides ride-through power to an electrical load during momentary disturbances in the power supply such as caused due to voltage sags, voltage swells, and momentary power outages that last for a limited time duration. Particularly, the charge stored in capacitor $C_R$ provides the ride-through functionality during a disturbance.

In FIG. 5A, the switch control circuit 204*b* comprises a control power supply 506 that provides conditioning of the AC line voltage ($V_{in}$) 201 and protection to connected electrical components (e.g., microprocessor 502). As will be apparent to one skilled in the art, control power supplies are easily available commercially and typically comprise a voltage regulator connected to several resistor, capacitors, and diodes, as shown in FIG. 5A for providing a regulated and rectified AC in order to power the microprocessor. According to one aspect, the control power supply 506 is capable of operating at voltages as low as 50% of AC line voltage ($V_{in}$) 201. This allows the microprocessor to be kept powered on for worst case line voltage conditions. By virtue of such a control power supply 506, even during disturbances (such as due to sags, swells, etc.) in the power supply, the operation of the microprocessor remains mostly unaffected.

According to another aspect, the control power supply 502 provides a scaled down value of the AC line voltage ($V_{in}$) 201 as input to the microprocessor 502. According to one aspect, the scaled down value of the AC line voltage ($V_{in}$) 201 enables the microprocessor to detect an instantaneous value of the AC line voltage ($V_{in}$) 201. As will be understood, the microprocessor samples a representative (instantaneous) AC voltage that is a scaled down value of the (instantaneous) AC line voltage ($V_{in}$) 201.

In one embodiment, the microprocessor is connected to a DC relay coil 510 that actuates (activates/deactivates) a SPDT relay. At any instant, the contacts of the SPDT relay are configured to be placed in any one of two positions: $N_o$ and $N_c$. For example, initially at startup, or in the at-rest state when the input AC line voltage 201 is within nominal bounds, the SPDT relay is at $N_c$ (normally closed) position as shown in FIG. 5A, thereby creating a path of flow of current between the load and the input AC line. The $N_c$ (normally closed) position, is the at-rest position of the relay when the relay is not activated. When the DC relay coil 510 is activated by a switching (control) signal from the microprocessor, the resulting electromagnetic field causes the actuator arm of the relay to connect to the common terminal to the $N_o$ (normally open) position, in which case the relay is closed.

Therefore, as will be understood, during a ride-through, the SPDT relay is placed in the $N_o$ position, thereby connecting a ride-through circuit to the load. At the end of the ride-through, when normal line voltages are restored, the microprocessor ensures that the contacts of the SPDT relay return to position $N_c$.

In one embodiment, the microprocessor 502 senses a scaled value of the AC line voltage ($V_{in}$) 201, and then, if the sensed voltage lies outside predetermined limits, the microprocessor 502 transmits a signal to the DC relay coil 510 such that the SPDT relay is placed in the $N_o$ position, thereby effecting the desired ride-through function. As will be understood, as long as the AC line voltage ($V_{in}$) 201 is within predetermined limits, the relay contacts are placed in the $N_c$ position so that the load is connected to the input AC line voltage via the relay contacts. Therefore, from the above, it will be understood that a microprocessor coupled to a DC relay coil allows the electrical load to be disconnected from the power supply thereby providing a ride-through function as described herein, as well as some degree of protection to the load from damage due to voltage sags and voltage swells.

A microprocessor 502 suitable for use in embodiments of this aspect of the apparatus preferably includes an A/D converter for sampling the representative AC voltage that is provided as input at the terminal labeled SENSE as shown in FIG. 5A. Exemplary details of the microprocessor's logic (steps) are explained with a flow chart in connection with FIG. 6A.

In one exemplary embodiment, the microprocessor used in the circuit shown in FIG. 5A (and also in FIG. 5B) belongs to the 8-bit PIC® or 16-bit PIC® family of microcontrollers manufactured by Microchip Technology, Inc., located in Chandler, Ariz. Details of the exemplary microcontroller are available in the literature supplied by the manufacturer, which are incorporated herein by reference.

In one exemplary aspect, the embodiment shown in FIG. 5A provides feedback to the consumer and/or the respective service provider. For example, in the embodiment shown in FIG. 5A, the microprocessor is connected to 2 LEDs, e.g., a red LED 508A and a blue LED 508B that blink according to some predefined pattern or color in order to signal a condition of the input AC line voltage.

It will be understood that for purposes of example and explanation in this disclosure, it has been assumed that the disturbances in the power supply last 1-15 cycles. Such an assumption is generally utilized in design considerations of the ride-through circuit, particularly, in one example, the value of the capacitor in the ride-through circuit is selected based on the assumption of the duration of the disturbance. Therefore, as referred to herein, disturbances in the power supply that are momentary, or, in other words, disturbances that last a short duration of time (e.g., lasting about 1-15 cycles) have been considered. However, time duration of voltage sags, voltage swells, and power outages can vary. For example, in many scenarios, power outages can last longer than 15 cycles.

Typically, disturbances (e.g., sags and swells) in the AC line voltage are typically of short duration, but the interruption to the associated service as manifested in a consumer's electronic devices (e.g., router, set-top box, converter, modem, etc.), lasts a longer time. For example, if it assumed that typical disturbances last between 1-15 cycles (or, equivalently between 0.166-0.25 milliseconds), then the interruption to the service including time to reboot, etc. can last from one minute upto a few minutes. Thus, it will be apparent that the alert/notification provided to the consumer/service provider needs to last for a duration significantly longer than the duration of the disturbances in the AC line voltage. This can be achieved with LED indication(s) that last longer, say ten minutes after the disturbance is detected in the AC line voltage. In one example, a microprocessor in combination with the LEDs can be used to visually communicate (e.g., using pulse-coded modulation or some other mechanism) a history of power disturbances that have been recorded. A line cord (e.g., as shown in FIG. 1) in that aspect, functions as a "black-box", providing functionalities of recording and reporting a history of past power disturbances in the AC line voltage.

Thus, according to one aspect, the LEDs 508A and 508B blink according to a predetermined pattern (as determined by pre-coded logic in the microprocessor) thereby providing a visual indication of an instantaneous condition of the AC line voltage ($V_{in}$) 201. Although in the disclosed embodiment, 2 LEDs have been shown, it will be understood that no limitations are imposed on the number or type of LEDs in alternate embodiments of the present disclosure. Also, it will be understood by one of ordinary skill in the art that various types of visual indications (e.g., different blinking patterns, colors, or any combinations of the above) can be provided.

In some instances, a microprocessor might fail due to a malfunction, or even from disturbances (voltage sags, swells, etc.) in the power line supply. Thus, in such instances, it is apparent from FIG. 5A that the load 208 stays connected to the power line supply at all times because the SPDT relay remains in the $N_c$ position thereby allowing a direct path for the flow of current. Consequently, if the AC line voltage experiences disturbances, the load is exposed to such disturbances because the microprocessor fails to effect ride-through functionality. Therefore, an alternate embodiment is described below wherein ride-through functionality is provided to a connected load even when the microprocessor fails.

Now referring to FIG. 5B, a circuit 500B is shown according to an alternate aspect, comprising a DC relay control circuit that is configured to operate in conjunction with a ride-through circuit. As will be understood, this DC relay coil embodiment has the same components as the embodiment shown in FIG. 5A, although it has a different mode of operation. For example, in contrast to FIG. 5A, the contacts of the SPDT relay shown in FIG. 5B are placed at $N_c$ initially, thereby providing protection to the load 208 at startup. Additional details of operation of the circuit 500B, along with steps followed by the microprocessor will be explained in connection with FIG. 6B.

It will be apparent to one skilled in the art that in alternate embodiments, circuits 500A and 500B can be designed with different circuit components, and configurations (e.g., different placement of relay contacts, etc.). In one exemplary embodiment considered for circuits 500A and 500B, the value of the resistance $R_s$ is chosen between 300 ohms and 400 ohms. The value of the resistance $R_x$ is chosen between 1 ohm and 10 ohms, and the capacitor $C_R$ is chosen as a few thousand microFarads.

Turning to FIG. 6A, exemplary microprocessor logic 600A is shown as steps of a flowchart, corresponding to the embodiment of the circuit 500A described earlier in FIG. 5A. Particularly, it will be understood that the steps shown in FIG. 6A are included as a program included in the digital logic of the microprocessor 502. For the embodiment in FIG. 5A, it is assumed that the contacts of the SPDT relay are at $N_c$ position at startup.

At step 602, the microprocessor powers on, or is reset from a prior shutdown mode. At step 604, the microprocessor senses the input line voltage. Specifically, the microprocessor senses a scaled down value (as scaled by the control power supply 506) of the input AC line voltage. This scaled down voltage is also referred to herein as a representative AC voltage, i.e., representative of the actual input AC line voltage. Then, the microprocessor determines (at step 606) whether or not the representative voltage differs from a predetermined threshold or, lies outside a predetermined range. For example, if the nominal bounds (predetermined range) in the input AC line voltage lie within 70V and 140V, for the microprocessor, an equivalent voltage range scaled down by the combination of the power supply 506 and the voltage divider network, is for example, between 2V and 2.9V. Because of the one-to-one mapping between the "representative AC voltage" and the actual "input AC line voltage (a/k/a line voltage)", the above-mentioned voltages have been used herein synonymously.

If the microprocessor determines (at step 606) that the input AC line voltage lies within a predetermined range, then at step 608 the microprocessor further determines whether or not the relay is in $N_c$ position. As will be understood, the microprocessor typically provides or transmits a control signal to the DC relay coil such that the relay (is activated) and placed in $N_o$ position. Removal (turning off) of the control signal results in the relay returning to the $N_c$ position. Thus, if the relay is already in the $N_c$ position (e.g., at startup, or when normal conditions prevail in the input AC line voltage), then the microprocessor reverts back to step 604 and continues to sense the AC line voltage. As will be apparent to one skilled in the art, there are two states corresponding to whether or not the control signal is being provided by the microprocessor. In other words, the microprocessor is a state-aware device and maintains (in internal memory registers) a log of whether or not a control (switching) signal is being provided to the DC relay coil. As will be further recalled, as long as the switching signal is provided by the microprocessor, the relay stays in $N_c$ position. Therefore, in one aspect, contents stored in the microprocessor's internal memory register correspond to the where the current position of the relay is.

If the microprocessor determines that the relay is not in the $N_c$ position (or equivalently, a switching signal is not being provided by the microprocessor to the DC relay coil) even when the AC line voltage is within predetermined limits, then the microprocessor deactivates (at step 610) the SPDT relay so that the relay is placed in the $N_c$ position thereby connecting the power supply to the load 208. As recited previously, typically removes (turns off) a switching signal (a/k/a control signal) to the DC relay coil 510 such that the SPDT relay is actuated to the $N_c$ position. In one exemplary instance, this happens at the end of a ride-through period.

Next, the microprocessor reverts back to step 604 and continues to sense the AC line voltage. It will be understood that during normal operating conditions of the power supply, the capacitor $C_R$ is charged via current flowing through the forward-biased diode $D_1$ and resistor $R_s$. Further, the charge stored in the capacitor is delivered to the load providing ride-through functionality.

If the microprocessor determines (at step 606) that the AC line voltage is not within predetermined range, then the microprocessor effects the ride-through functionality of the circuit 500A. Thus, at step 611, the microprocessor determines an event type corresponding to the disturbance (e.g., voltage sag, voltage swell, power outage, etc.) in the power supply, and subsequently at step 612 transmits (provides) a switching (control) signal to the DC relay coil which activates the SPDT relay so that the SPDT relay is placed in the $N_o$ position for ride-through. It will be understood by one skilled in the art that the microprocessor can determine a type of event according to various methodologies. One such methodologies are described in what follows next.

As recited previously, the microprocessor, in one embodiment samples an instantaneous value of the line AC voltage (or, equivalently, a representative AC voltage) in step 604. Also, it is assumed that the microprocessor allows voltage deviations for some predetermined number of samples. This prevents nuisance indications or, basically false alarms of a disturbance in the power supply and thereby prevents unnecessary wear and tear of the relay contacts. Moreover, in one exemplary aspect, the microprocessor determines a voltage deviation as a particular type of disturbance if the line AC voltage (or, equivalently, a representative AC voltage) lies within predetermined thresholds, corresponding to various types of disturbances.

As discussed and shown in FIG. 3, a power outage typically corresponds to zero or almost zero voltage. A voltage sag is characterized by 10%-90% drops in line voltage. Voltage swells are similar increases in line voltage. Therefore, for example, a first threshold to identify power outages will be less than a second threshold to identify voltage sags, which in turn, will be less than a third threshold to identify voltage swells. Thus, for example, if the line AC voltage lies between zero volts and the first threshold voltage, and remains in that interval at least for a predetermined number of samples, then the microprocessor identifies the disturbance as a power outage. If the line AC voltage lies between the first threshold voltage and the second threshold voltage for at least a predetermined number of samples, then the microprocessor identifies the disturbance as a voltage sag. The determination of voltage swells is similar, and happens when the line AC voltage lies between the second threshold voltage and the third threshold voltage for at least a predetermined number of samples.

Those skilled in the art of programming of microprocessors or microcontrollers of the type as exemplified herein will be enabled by the foregoing to prepare program code to implement the above-described methodologies for identifying momentary power outages, sags, and swells. It will be further understood that the above-mentioned methodology of determining an event type is exemplary, and alternate embodiments can employ various other methodologies as will occur to one skilled in the art. For example, in embodiments wherein the microprocessor does not have a built-in A/D converter, the microprocessor can detect the peaks of the line AC voltage, and make a determination based on the peak value of the line AC voltage.

Still continuing with FIG. 6A (or, generally speaking FIG. 5A), during the ride-through (typically a few milliseconds or a few seconds) the capacitor $C_R$ discharges through the resistance $R_x$ slowly to provide the ride-through function needed. Next, at step 614, the microprocessor registers (inside non-volatile memory) the event corresponding to the AC line voltage not lying within a predetermined range. For example, the microprocessor registers various kinds of data such as a line current flowing from the power supply, an input AC line voltage, time stamps when the data was registered, etc. Then, at step 616, the microprocessor optically communicates (e.g., via LEDs 508A and 508B) an indication corresponding to this line condition and further classifies such a condition into specific types of predefined events (e.g., voltage sag, voltage swell, etc.). Subsequently, the logic returns back to step 604 and continues to sense the AC line voltage.

Referring now to FIG. 6B, exemplary microprocessor logic 600B is shown as steps of a flowchart, corresponding to the embodiment of the circuit 500B described earlier in FIG. 5B. Particularly, it will be understood that the steps shown in FIG. 6B are included as a program included in the digital logic of the microprocessor 502. For the embodiment in FIG. 5B, it is assumed that the contacts of the SPDT relay are at $N_c$ position at startup, thereby providing protection to the load 208 at startup.

As shown in FIG. 6B, at step 650, the microprocessor powers on, or is reset from a prior shutdown mode. At step 652, the microprocessor senses the input line voltage. Specifically, the microprocessor senses a scaled down version (as scaled by the control power supply 506) of the input AC line voltage. Then, the microprocessor determines (at step 654) whether or not the input AC line voltage lies within a predetermined range. For example, the microprocessor senses whether or not the input AC line voltage lies within 70V and 120V, or more particularly for the microprocessor, an equivalent voltage range scaled down by the power supply 506, for example, between 2V and 2.9V.

If the microprocessor determines (at step 654) that the input AC line voltage lies within a predetermined range, then at step 656 the microprocessor further determines whether or not the relay is already in $N_o$ position. As recited previously, the microprocessor is a state-aware device and maintains (in internal memory registers) a log of whether or not a control (switching) signal is being provided to the relay or not. As will be understood, as long as the switching signal is provided by the microprocessor, the relay stays in No position. Therefore, in one aspect, contents stored in the microprocessor's internal memory register correspond to where the current position of the relay is.

If the microprocessor determines that the relay is not in the $N_o$ position (for example, at the end of a ride-through period) even when the AC line voltage is within predetermined limits, then the microprocessor activates (at step 658) the SPDT relay so that the relay is placed in the $N_o$ position thereby connecting the power supply to the load 208. As will be understood, the microprocessor typically transmits a control signal to the DC relay coil such that the relay (is activated) and placed in $N_o$ position. Removal of the control signal (or, lack of the control signal) indicates that the relay is in the $N_c$ position. Thus, if the relay is already in the $N_o$ position (e.g., when normal conditions prevail in the input AC line voltage), then the microprocessor reverts back to step 652 and continues to sense the AC line voltage. Next, the microprocessor reverts back to step 652 and continues to sense the AC line voltage. (It will be understood that during normal operating conditions of the power supply, the capacitor $C_R$ is charged via current flowing through the forward-biased diode and resistor $R_s$. Further, the charge stored in the capacitor is delivered to the load providing the ride-through.)

If the microprocessor determines (at step 654) that the AC line voltage is not within predetermined range, then the microprocessor effects the ride-through functionality of the circuit 500B. Thus, at step 660, the microprocessor determines an event type corresponding to a disturbance (e.g., voltage sag, voltage swell, power outage, etc.) in the power supply, and removes the switching signal (at step 661) to the DC relay coil which deactivates the SPDT relay so that the SPDT relay is placed in the $N_c$ position for ride-through. Details of various exemplary methodologies in determining event types, or in other words, types of disturbance in the power supply, have been discussed earlier in connection with FIG. 6A.

Continuing with FIG. 6B (or, generally speaking FIG. 5B), it will be understood that during a ride-through (typically a few milliseconds or a few seconds) the capacitor $C_R$ discharges through $R_x$ (the value of the discharging resistance $R_x$ is typically less than the value of the charging resistance $R_s$) to provide the ride-through functionality. Next, at step 662, the microprocessor registers (inside non-volatile memory) the event corresponding to the AC line voltage not lying within a predetermined range. For example, the microprocessor registers data such as a line current flowing from the power supply, an input AC line voltage, time stamps when the data was registered, etc. Then, at step 664, the microprocessor optically communicates (e.g., via LEDs 508A and 508B) an indication corresponding to this line condition and further classifies such a condition into specific types of predefined events (e.g., voltage sag, voltage swell, etc.). Subsequently, the logic returns back to step 652 and continues to sense the AC line voltage. In various scenarios (e.g., as discussed previously in connection with FIG. 4), an AC relay coil is utilized. In such scenarios, a microprocessor-based implementation connected to a DC relay coil and LEDs (for optically communicating disturbances in the power supply line), may not be applicable. Therefore, in such scenarios, a different type of a circuit is used to optically communicate disturbances in the power supply line. Such an exemplary circuit is described next.

Now turning to FIG. 7, an exemplary indicator circuit 700 is shown for purposes of visually communicating disturbances in the power supply line, according to one embodiment of the present disclosure. As shown, the circuit 700 comprises a 555 timer IC connected to another logic gate 710. In one exemplary aspect, logic gate 710 is a 555 timer IC. As will be understood, in circuit 700, a microprocessor is not used, and hence, a DC supply (or, more generally, a control power supply) is not utilized. Instead, a capacitive power supply is used to derive the supply voltage $+V_s$ for the 555 timer IC. It will be understood by one skilled in the art that the capacitive supply (for the circuit shown in FIG. 7) comprises capacitors $C_1$, $C_S$, as well as diodes $D_1$, $D_2$.

The diode $D_3$ in conjunction with resistors provide a negative going trigger signal to the 555 timer IC, thereby operating the 555 timer IC as a retriggerable monostable multivibrator. As shown in FIG. 7, such a trigger signal is provided as input to pin 2 of the 555 timer IC. During the negative half cycle of the AC line voltage ($V_{in}$) 201, the 555 timer IC is triggered with a positive going trigger signal which keeps its output (e.g., pin 3) high. With pin 3 high, the trigger network comprising diode $D_4$, resistor $R_t$, and capacitor Ct, are maintained at a high potential. As shown in FIG. 7, input to pins 6 and 7 are shorted together and connected to a RC network.

During a momentary power disturbance (such as a voltage sag), when the AC line voltage ($V_{in}$) 201 goes low for more than 1-2 cycles (depending on the RC network connected to pin 6 or, 7 of the 555 timer IC), the output of pin 3 drops low, thereby discharging Ct. When the line voltage is restored (even after 1-2 cycles), the capacitor $C_t$ take many minutes to charge up Ct (i.e. the capacitor $C_t$ and resistor $R_t$ are chosen such that time constant $R_tC_t$ is several minutes long). This keeps the output of the logic gate 710 high for many minutes, keeping the LED 720 lit. Consequently, this provides visual feedback to the user that a line disturbance has already occurred, even though the AC line voltage has now returned to normal levels. This allows the user to correlate a possible malfunction of their electronics equipment with a possible line disturbance (e.g., frequent voltage sags).

FIG. 8 shows an exemplary circuit comprising the exemplary AC relay circuit (shown previously in FIG. 4) coupled to the indicator circuit 700 (shown previously in FIG. 7), according to one embodiment of the present disclosure. As shown in FIG. 8, the indicator circuit 700 is connected across the input AC line voltage ($V_{in}$) 201 and provides additional functionalities (e.g., diagnostic feedback of disturbances in the power supply to users) on top of the ride-through functionalities provided by the capacitor $C_R$ included as part of the ride-through circuit 206*a* and discussed in detail in FIG. 4 previously. Details of operation of the indicator circuit have been discussed earlier in connection with FIG. 7.

The flowcharts of FIGS. 6A and 6B shows the architecture, functionality, and operations of exemplary logic implemented by the microprocessor 502 in the circuits shown in FIGS. 5A and 5B respectively. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s). Various functions and steps described previously can be implemented as a circuit or state machine that employs any-one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc. Such technologies are generally well known by those skilled in the art and, consequently, are not described in detail herein.

Also, where the microprocessor logic comprises software or code, each can be embodied in any computer-readable medium for use by or in connection with an instruction execution system such as, for example, a processor in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the microprocessor logic for use by or in connection with the instruction execution system. The computer readable medium can comprise anyone of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, or compact discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

What is claimed is:

1. A method for providing temporary power to an electrical load during momentary disturbances in an electrical power supply that provides an input AC line voltage to the electrical load, comprising the steps of:

providing a microprocessor for sensing a representative AC voltage corresponding to an instantaneous value of the input AC line voltage and for providing a switching signal in response to detection of a momentary disturbance in the electrical power supply;

providing a selectively actuatable switch coupled between the electrical power supply and the electrical load, the switch responsive to the switching signal provided by the microprocessor to be placed in either (i) a first switching state wherein the electrical load is directly coupled to the electrical power supply, or (ii) a second switching state in which the direct coupling is opened such that the load is disconnected from the electrical power supply;

providing a ride-through circuit comprising a first resistance, a second resistance, a diode, and a capacitance that charges from the electrical power supply through the diode and the first resistance when the switch is in the first switching state, the capacitance discharging through the second resistance to provide temporary power to the electrical load when the switch is in the second switching state;

upon detection by the microprocessor that the representative AC voltage indicates a momentary disturbance in the electrical power supply, changing the selectively actuatable switch from the first switching state to the second switching state such that the load is connected to the ride-through circuit for providing temporary power to the electrical load;

upon detection by the microprocessor that the representative AC voltage has returned to normal operating conditions, returning the selectively actuatable switch to the first switching state for recharging the capacitance.

2. The method of claim 1, further comprising the step of providing one or more light emitting diodes operatively coupled to the microprocessor for providing visual indication corresponding to determination of at least one type of momentary disturbance in the electrical power supply detected by the microprocessor.

3. The method of claim 2, wherein the at least one type of momentary disturbance does not exceed a predetermined number of cycles in the AC voltage and is selected from the following group: voltage swells, voltage sags, brownouts, overvoltages, and power outages.

4. The method of claim 1, wherein the momentary disturbance corresponds to detection that the representative AC voltage is less than a first predetermined threshold and the switch is currently in the first switching state.

5. The method of claim 1, wherein the momentary disturbance corresponds to detection that the representative AC voltage is greater than a first predetermined threshold and the switch is currently in the first switching state.

6. The method of claim 1, wherein the momentary disturbance corresponds to detection that representative AC voltage is less than a second predetermined threshold and the switch is currently in the second switching state.

7. The method of claim 1, wherein the momentary disturbance corresponds to detection that representative AC voltage is greater than a second predetermined threshold and the switch is currently in the second switching state.

8. The method of claim 1, wherein the selectively actuable switch comprises an electromechanical relay configured to be operated by DC power.

9. The method of claim 8, wherein the electromechanical relay is a singlepole, double-throw (SPDT) relay.

10. The method of claim 1, wherein the switch remains in the second state for a duration of about 15 cycles of 60 Hz of the AC line voltage, the capacitance in the ride-through circuit thereby providing temporary power to the electrical load for that duration.

11. The method of claim 1, wherein the switch assumes the first state at startup of the microprocessor.

12. The method of claim 1, wherein the switch assumes in the second state at start-up of the microprocessor.

* * * * *